United States Patent [19]

Minamizono et al.

[11] 4,330,618

[45] May 18, 1982

[54] PHOTOGRAPHIC LIGHT SENSITIVE MATERIAL

[75] Inventors: Junji Minamizono; Shinzo Kishimoto, both of Minami-ashigara; Takayuki Inayama, Fujinomiya, all of Japan

[73] Assignee: Fuji Photo Film Co., Ltd., Minami-ashigara, Japan

[21] Appl. No.: 212,651

[22] Filed: Dec. 3, 1980

[30] Foreign Application Priority Data

Dec. 3, 1979 [JP] Japan ..... 54-156473

[51] Int. Cl.[3] ..... G03C 5/26; G03C 1/76

[52] U.S. Cl. ..... 430/528; 430/523; 430/527; 430/529; 430/631; 430/609; 430/627; 430/629; 430/630; 430/961; 430/536; 430/537

[58] Field of Search ..... 430/961, 523, 609, 527, 430/528, 213, 529, 627, 630, 629, 631, 536, 537

[56] References Cited

U.S. PATENT DOCUMENTS

| | | | |
|---|---|---|---|
| 4,142,899 | 3/1979 | Sato et al. | 430/213 |
| 4,154,615 | 5/1979 | Sato et al. | 430/213 |
| 4,193,800 | 3/1980 | Iwama et al. | 430/213 |
| 4,255,515 | 3/1981 | Shibue et al. | 430/527 |

*Primary Examiner*—Mary F. Downey

*Attorney, Agent, or Firm*—Sughrue, Mion, Zinn, MacPeak and Seas

[57] ABSTRACT

A photographic light-sensitive material containing a copolymer comprising a betaine group-containing monomer and a fluorine atom-containing monomer in at least one photographic layer thereof, whereby the material is improved in the antistatic properties without adversely affecting its photographic properties.

6 Claims, No Drawings

PHOTOGRAPHIC LIGHT SENSITIVE MATERIAL

BACKGROUND OF THE INVENTION

This invention relates to silver halide photographic light-sensitive materials having improved antistatic properties, and more particularly to photographic light-sensitive materials improved in antistatic and antiadhesion properties without adversely affecting photographic characteristics.

When photographic light-sensitive members are brought into contact with each other or the surface of a different substance, or stripped during the production or use thereof, electrostatic charges are often accumulated thereon by the contact friction or stripping, because they usually comprise an electrically insulating support and a photographic layer or layers. Such accumulated electrostatic charges give rise to various problems. Of these problems, the most serious is that the light-sensitive emulsion layer is exposed to light by discharge of the electrostatic charges accumulated before development processing, resulting in the formation of dot-like spots or tree- or feather-like line marks when photographic light-sensitive materials are developed.

These spots or line marks are called "static marks" and markedly lower the product value. In some cases, the product value is completely lost. For example, static marks appearing on medical or industrial X-ray films or the like may cause very dangerous misjudgments. The formation of such static marks is a very troublesome problem because it cannot be revealed until photographic films are developed. Furthermore, these accumulated electrostatic charges cause secondary problems, e.g., attachment of dust on the surface of photographic films and uneven coating.

The accumulation of electrostatic charges may occur during the production of the photographic light-sensitive materials or at the time of using them. For example, at production steps, the accumulation of electrostatic charges is caused by the contact friction between photographic films and rollers, or by the stripping or separation of the emulsion layer from the back side of the support during the step of winding or rewinding photographic films. At the time of using finished products, the separation of the emulsion layer from the back side of the support, for example in the case of X-ray films, due to the contact of X-ray films with mechanical parts of an automatic camera in which the X-ray film is placed or fluorescent intensifying paper is responsible for the accumulation of electrostatic charges. Additionally, the contact of X-ray films and wrapping materials causes the accumulation of electrostatic charges.

The formation of static marks on photographic light-sensitive materials which is caused by the accumulation of electrostatic charges becomes more significant with increases in the sensitivity of the photographic light-sensitive material and with increases in the processing rate thereof. Nowadays in particular, photographic light-sensitive materials are increasingly subjected to high sensitization and severe handling, e.g., high-speed coating, high-speed photographing, high-speed automatic processing, etc. This leads to easier formation of static marks.

Where an undercoating layer (sometimes referred to as a subbing layer) is provided on a film support, and a hydrophilic colloid layer, e.g., a light-sensitive silver halide emulsion layer, is provided on the undercoating layer, if electrostatic charges are accumulated on the surface of the undercoating layer, the coating of the hydrophilic colloid layer will become uneven according to the unevenness in the accumulation of electrostatic charges. This is a serious disadvantage.

The best method of removing the above-described problems is to increase the electrical conductivity so as to make accumulated electrostatic charges dissipate in a short time, before the discharge thereof.

Therefore, various methods of increasing the electrical conductivity of the support or various surface layers by incorporating therein various hygroscopic substances, water-soluble inorganic salts, surface active agents, polymers, etc., have heretofore been proposed. As such additives, polymers as described, for example, in U.S. Pat. Nos. 2 ,882,157, 2,972,535, 3,062,785, 3,262,807, 3,514,291, 3,615,531, 3,753,716 and 3,938,999, surface active agents as described, for example, in U.S. Pat. Nos. 2,982,651, 3,428,456, 3,457,076, 3,454,625, 3,552,972, and 3,655,387, and zinc oxide, semiconductors, colloid silica, etc., as described, for example, in U.S. Pat. Nos. 3,062,700, 3,245,833 and 3,525,621, are known.

Many of these substances, however, exhibit specificity, and change their effects according to the type of the support and differences in the photographic composition; that is, they provide good results when used with specific film supports and photographic emulsions, but when used with other film supports and photographic elements, they are not effective in preventing charging, and sometimes exert bad influences on photographic characteristics.

Even with such methods for increasing electrical conductivity, preventing the hydrophilic colloid layer from becoming charged is very difficult. Insufficient reduction in surface resistance at low humidities, and problems due to the contact surfaces of a photographic light-sensitive material itself, or between such material and other substances at high temperatures and humidities often take place.

On the other hand, there are some substances which are excellent in their antistatic effect, but which cannot be used because they adversely affect photographic characteristics, such as sensitivity, photographic fog, graininess, sharpness, etc., or they cause the formation of scum in a fixer. For example, although polyethylene oxide compounds are generally known to have the antistatic effect, they often exert adverse influences on photographic characteristics, such as causing an increase in fog, desensitization, reduction of graininess, etc. Additionally, copolymers of tertiary nitrogen-containing monomers and fluorine-containing monomers are effective in improving antistatic and antiadhesion properties, but their adverse influences on photographic characteristics, such as sensitivity, fog, etc., of photographic emulsions, are not improved to an extent that is completely satisfactory.

Furthermore, the antistatic ability of antistatic agents contained in photographic light-sensitive materials often deteriorates over a period of time due to the transfer and diffusion thereof during the storage of the photographic light-sensitive materials. Thus, application of antistatic agents to photographic light-sensitive materials is very difficult and the applications in which they are useful are limited.

SUMMARY OF THE INVENTION

An object of this invention is to provide a photographic light-sensitive material having improved antistatic properties.

Another object of this invention is to provide a photographic light-sensitive material with antistatic properties without adversely affecting its photographic characteristics, such as sensitivity, fog, graininess, sharpness, etc.

A further object of this invention is to provide an antistatic photographic light-sensitive material which is free from any adverse effects due to electrification.

It has now been found according to this invention that these objects can be attained by incorporating a copolymer comprising a betaine group-containing polymerizable monomer and a fluorine atom-containing polymerizable monomer in at least one layer of those constituting a photographic layer.

DETAILED DESCRIPTION OF THE INVENTION

Particularly preferred copolymers used in this invention are prepared by copolymerizing betaine group-containing polymerizable monomers represented by formula (I) and fluorine atom-containing polymerizable monomers represented by formula (II).

The monomer of formula (I) can be represented by

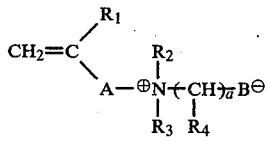

(I)

wherein

A can represent an alkylene group containing from 1 to 6 carbon atoms, and preferably from 1 to 3 carbon atoms; an arylene group containing from 7 to 11 carbon atoms, and preferably from 7 to 9 carbon atoms; an aralkylene group containing from 8 to 12 carbon atoms, and preferably 8 carbon atoms; a —COOR$_5$—, CONHR$_5$—, or

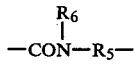

group, wherein R$_5$ is an alkylene group containing from 1 to 6 carbon atoms, and preferably from 1 to 4 carbon atoms, and R$_6$ is an alkyl group containing from 1 to 8 carbon atoms, and preferably from 1 to 4 carbon atoms; or A can form, together with

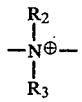

group, a heterocyclic ring or a group containing a heterocyclic ring (e.g., a pyridine ring, an imidazole ring, a piperazine ring, etc.);

R$_1$ is hydrogen or a lower alkyl group (e.g., preferably a methyl group);

R$_2$ and R$_3$ (which may be the same or different) can represent an alkyl group containing from 1 to 6 carbon atoms, and preferably from 1 to 4 carbon atoms, an aryl group containing from 7 to 11 carbon atoms, and preferably from 7 to 9 carbon atoms, or

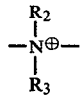

can form, together with A, a heterocyclic ring or a group containing a heterocyclic ring (e.g., a pyridine ring, an imidazole ring, a piperazine ring, etc.);

R$_4$ is hydrogen or an alkyl group containing from 1 to 6 carbon atoms, and preferably from 1 to 3 carbon atoms;

a is a positive integer, preferably from 1 to 6, and more preferably from 1 to 4; and B$^{\ominus}$ is —COO$^{\ominus}$ or —SO$_3^{63}$.

Examples of the heterocyclic ring and the group containing a heterocyclic ring formed by A together with

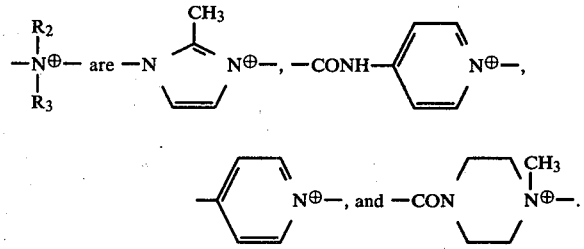

Typical examples of betaine monomers which are particularly preferably used in this invention are as follows:

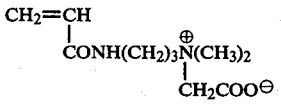

(I-1)

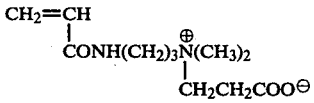

(I-2)

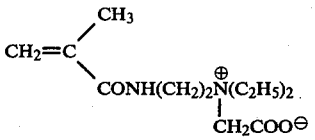

(I-3)

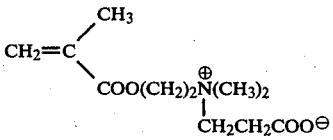

(I-4)

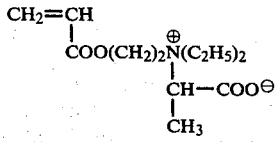

(I-5)

-continued (I-6)

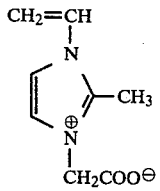

(I-7)

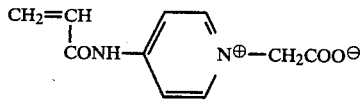

(I-8)

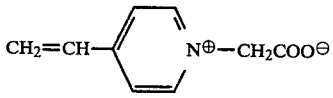

(I-9)

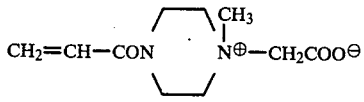

(I-10)

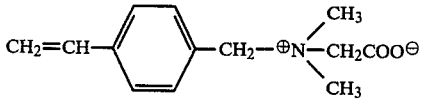

(I-11)

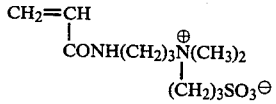

(I-12)

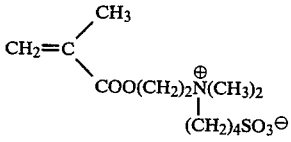

(I-13)

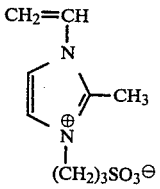

(I-14)

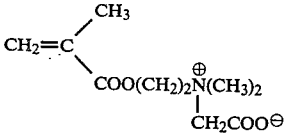

The monomer of formula (II) can be represented by (II)

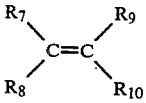

wherein $R_7$, $R_8$, $R_9$, $R_{10}$ is each hydrogen; a fluorine atom; a lower alkyl group; $-(CF_2)_nF$, wherein n is an integer from 1 to 8; $-O(CF_2)_nF$, wherein n is an integer from 2 to 8; $-O(CF_2)_nH$, wherein n is an integer from 2 to 8; $-COO(CH_2)_m-(CF_2)_nH$, wherein m is an integer from 1 to 3, and n is an integer from 2 to 8; $-COO(CH_2)_m(CF_2)_nF$, wherein m is an integer from 1 to 3, and n is an integer from 2 to 8;

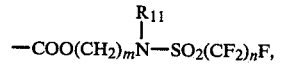

wherein m is an integer from 1 to 3, n is an integer from 2 to 8, and $R_{11}$ is an alkyl group containing from 1 to 4 carbon atoms; $-COO(CH_2)_mO-(CF_2)_nF$, wherein m is an integer from 1 to 3, and n is an integer from 2 to 8;

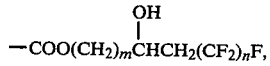

wherein m is an integer from 1 to 3, and n is an integer from 2 to 8;

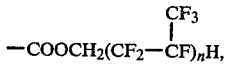

wherein n is an integer from 1 to 4; $-OCO(CH_2)_m(CF_2)_nF$, wherein m is zero or an integer from 1 to 3, and n is an integer from 1 to 8; $-OCO(CH_2)_m(CF_2)_nH$, wherein m is zero or an integer from 1 to 3, and n is an integer from 1 to 8;

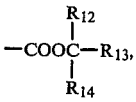

wherein $R_{12}$, $R_{13}$ and $R_{14}$ each is a fluorine atom or a fluorine-substituted alkyl group containing 1 to 4 carbon atoms; $-CONH(CF_2)_nF$, wherein n is an integer from 2 to 8; or $-CONH(CF_2)_nH$, wherein n is an integer from 2 to 8.

$R_7$, $R_8$, $R_9$ and $R_{10}$ may be the same or different, but at least one of them is a group containing a fluorine atom.

Typical examples of fluorine-containing monomers which are particularly preferably used in this invention are as follows:

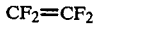

(II-1)

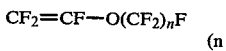

(II-2)

(n = 2–8)

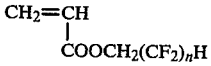

(II-3)

(n = 2–8)

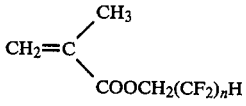

(II-4)

(n = 2–8)

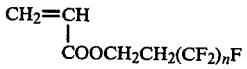

(II-5)

(n = 2–8)

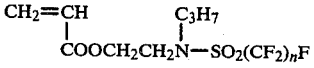

(II-6)

(n = 2–8)

-continued

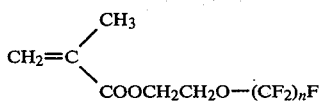

(II-7)

(n = 2–8)

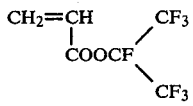

(II-8)

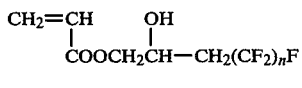

(II-9)

(n = 2–8)

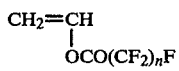

(II-10)

(n = 3–7)

Copolymers which are used in this invention can contain other comonomers in addition to betaine-containing monomers and fluorine-containing monomers. In view of solubility considerations and the objects of this invention, however, the total of the betaine-containing monomer content and fluorine-containing monomer content is preferably at least 50 mol%. More preferably, the betaine-containing monomer content is from 95 to 50 mol%, the fluorine-containing monomer content is from 50 to 5 mol%, and the other copolymerization component content is from 45 to 0 mol%.

Examples of comonomers which can be used in this invention include acrylic acid, methacrylic acid, and their alkyl esters (e.g., methyl methacrylate, ethyl acrylate, hydroxyethyl acrylate, propyl acrylate, cyclohexyl acrylate, 2-ethylhexyl acrylate, decyl acrylate, β-cyanoethyl acrylate, β-chloroethyl acrylate, 2-ethoxyethyl acrylate, sulfopropyl methacrylate, etc.), vinyl esters (e.g., vinyl acetate, vinyl propionate, vinyl butyrate, etc.), vinyl ethers (e.g., methyl vinyl ether, butyl vinyl ether, oleyl vinyl ether, etc.), vinyl ketones (e.g., methyl vinyl ketone, ethyl vinyl ketone, etc.), styrenes (e.g., styrene, methylstyrene, dimethylstyrene, 2,4,6-trimethylstyrene, ethylstyrene, laurylstyrene, chlorostyrene, methoxystyrene, cyanostyrene, chloromethylstyrene, vinylbenzoic acid, styrenesulfonic acid, α-methylstyrene, etc.), vinylheterocyclic compounds (e.g., vinylpyridine, vinylpyrrolidone, vinylimidazole, etc.), acrylonitrile, vinyl chloride, vinylidene chloride, ethylene, propylene, butadiene, diisobutylene, isoprene, chloroprene, and so forth.

This invention is not limited to the above-described copolymerizable comonomers, and any copolymerizable comonomers other than the above-described copolymerizable comonomers can be used in this invention.

Typical examples of copolymers which can be used in this invention are shown below. Copolymerization ratios of x, y and z are given by way of illustration, and this invention is not limited thereto.

Copolymer (1)

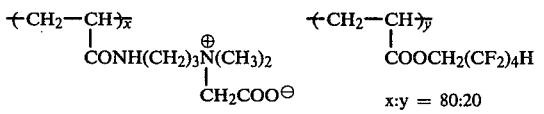

x:y = 80:20

Copolymer (2)

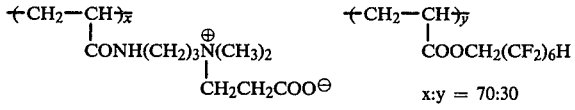

x:y = 70:30

Copolymer (3)

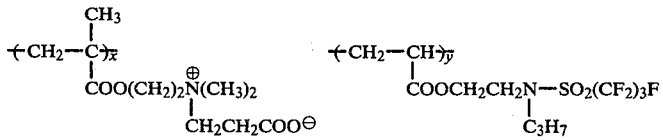

x:y = 65:35

Copolymer (4)

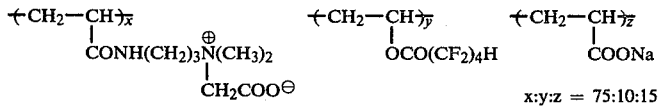

x:y:z = 75:10:15

Copolymer (5)

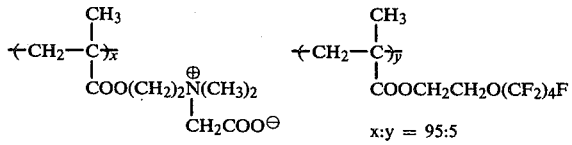

x:y = 95:5

Copolymer (6)

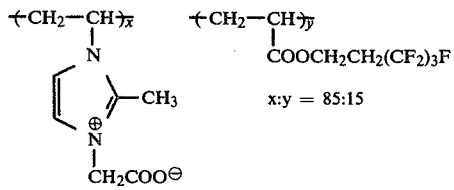

x:y = 85:15

-continued

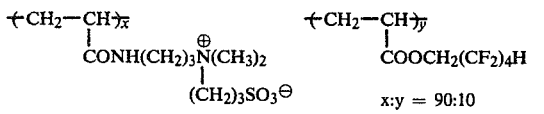

x:y = 90:10 Copolymer (7)

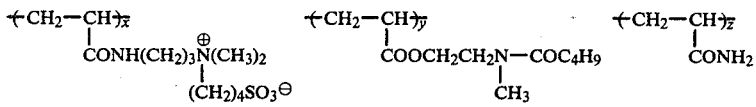

x:y:z = 60:20:20 Copolymer (8)

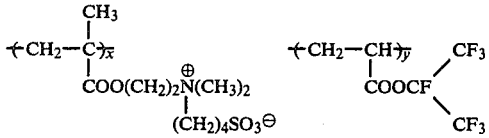

x:y = 75:25 Copolymer (9)

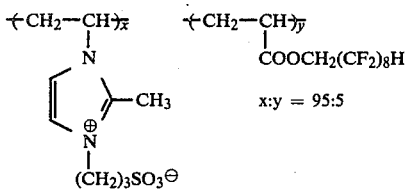

x:y = 95:5 Copolymer (10)

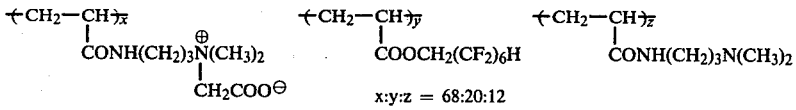

x:y:z = 68:20:12 Copolymer (11)

For the synthesis of betaine monomers which can be used in this invention, methods as described, for example, in U.S. Pat. Nos. 2,777,872, 2,846,417, 3,411,912, 3,832,185, 4,012,437, Japanese Patent Publication Nos. 3832/70, 19951/70, 30293/71, 1040/74, and *Polymer*, Vol. 18, page 1058 (1977) can be employed.

Fluorine-containing monomers can be synthesized by reference to U.S. Pat. Nos. 2,436,144, 2,592,069, 2,628,958, 2,642,416, 2,803,615, 3,102,103, 3,491,169, 3,714,245, Japanese Patent Publication Nos. 12883/67, 9205/68, 20466/68, 851/69, 1994/69, 26286/69, 29724/71, 42371/71, 43894/71, 20609/72, Japanese Patent Application (OPI) Nos. 52019/75, 121184/75, 134040/75, 134046/75 (The Term "OPI" as used herein refers to a "published unexamined Japanese patent application"), Lovelace et al., *Aliphatic Fluorine Compounds*, (Reinhold), and so forth.

Copolymers according to this invention can be synthesized by polymerization methods such as solution polymerization, emulsion polymerization, etc., and a reaction solvent, a reaction temperature, etc., suitable for use in this polymerization are selected. Production of these copolymers can be attained by a procedure in which a tertiary amine-containing monomer which is not yet betainized and a fluorine-containing monomer are first copolymerized and the resulting copolymer is then subjected to betainization (i.e., the tertiary amine thereof is quaternarized with a compound having a sulfonic acid group or carboxylic acid group).

Synthesis examples of typical copolymers as used in this invention are shown below:

SYNTHESIS EXAMPLE 1

Preparation of Copolymer (1)

34.2 g (0.16 mol) of a betaine-containing monomer represented by the formula

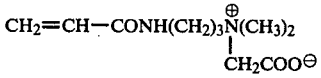

and 11.5 g (0.04 mol) of a fluorine-containing monomer represented by the formula

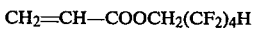

were dissolved in 150 ml of methanol, and the resulting solution was stirred while heating at 60° C. in an atmosphere of nitrogen. After dropwise addition of a solution prepared by adding 0.2 g of AIBN (α,α'-azobisisobutyronitrile) of the formula

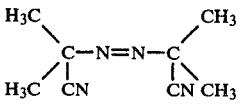

to 20 ml of methanol, the monomers were reacted for 8 hours. The reaction mass was allowed to cool, and the methanol was then removed to convert into an aqueous solution. This aqueous solution was dialyzed to remove unreacted monomers and freeze-dried to obtain a white powder. The yield was 42.1 g. With elemental analysis, it was found that the fluorine content of the copolymer obtained was 13.3 wt %. This value confirmed that the copolymer obtained was Copolymer (1).

SYNTHESIS EXAMPLE 2

Preparation of Copolymer (5)

149.3 g (0.95 mol) of a monomer represented by the formula

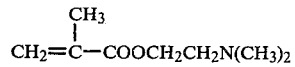

and 17.4 g (0.05 mol) of a fluorine-containing monomer represented by the formula

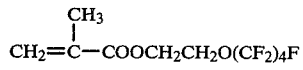

were dissolved in 500 ml of methanol, and the resulting solution was stirred while heating at 60° C. in an atmosphere of nitrogen. In the same manner as in Synthesis Example 1, 0.5 g of AIBN was added as an initiator and the polymerization was carried out for 10 hours. To the polymer solution obtained were added 107.7 g (1.14 mol) of monochloroacetic acid and 220 g (1.14 mol) of a 28% methanol solution of sodium methylate, and the resulting solution was stirred while heating at 60° C. for 6 hours. The solution was allowed to cool, and it was then adjusted to a constant volume in order to analyze the degree of the betainization. A part of the solution was removed, diluted with pure water, and measured with respect to $Cl^{\ominus}$ with 0.1 N silver nitrate. On the basis of the results obtained, the degree of betainization was calculated and found to be 100%.

The subsequent procedure was carried out in the same manner as in Synthesis Example 1, and 198 g of a white polymer was obtained. With elemental analysis, it was found that the fluorine content of the copolymer obtained was 5.1wt %. This value confirmed that the copolymer obtained was Copolymer (5).

The copolymer of this invention is added to at least one member of those layers constituting the photographic light-sensitive material (hereinafter referred to as the "photographic layers"). These photographic layers are those other than the silver halide emulsion layer, such as a surface protective layer, a backing layer, an intermediate layer, an undercoat layer (i.e., a subbing layer), etc. When the backing layer consists of two layers, the copolymer of this invention can be added to any one of the layers. Moreover, the copolymer can be overcoated on the surface protective layer.

To exhibit the effect of this invention to a maximum, the copolymer of this invention is preferably added to the surface protective layer, the backing layer or the overcoat layer.

In applying the copolymer of this invention to the photographic light-sensitive material, it is dissolved in water or an organic solvent, such as methanol, isopropanol, acetone or the like, or a mixed solvent thereof, and then added to a coating solution for use in forming the surface protective layer or backing layer. The coating solution containing the copolymer of this invention is coated by dip coating, air knife coating, or an extrusion coating method using a hopper as described in U.S. Pat. No. 2,681,294. Alternatively, two or more layers can be coated at the same time by methods as described in U.S. Pat. Nos. 3,508,947, 2,941,898, 3,526,528, etc., or the material can be soaked in the antistatic solution. If desired, the antistatic solution containing the copolymer of this invention is coated on the protective layer.

The amount of the copolymer of this invention being coated per square meters of the photographic material is from 0.01 g to 20 g, and particularly preferably from 0.02 g to 5.0 g. These ranges, of course, vary depending upon the type of the photographic film base, photography, composition, shape or coating method.

As a support for use in the photographic light-sensitive material of this invention, a cellulose nitrate film, a cellulose acetate film, a cellulose acetate butyrate film, a cellulose acetate propionate film, a polystyrene film, a polyethylene terephthalate film, a polycarbonate film, laminates of such films, etc., can be used. Additionally, a baryta or $\alpha$-olefin polymer (particularly, polymers obtained from $\alpha$-olefin containing from 2 to 10 carbon atoms, such as polyethylene, polypropylene, an ethylene-butene copolymer, etc.) coated or laminated paper can be used.

According to the purpose of using the photographic light-sensitive material of this invention, either a transparent support or an opaque support can be employed. In addition to a colorless transparent support, a colored transparent support which is colored by adding dye, pigment or the like can be used.

Where the adhesion force between the support and the photographic emulsion layer is insufficient, a layer capable of adhering to both the layers can be provided as an undercoat layer. To further improve the adhesion between the layers, preliminary treatments customarily applied, such as corona discharge, ultraviolet ray irradiation, a flame treatment, etc., may be applied to the surface of the support.

Each photographic material-constituting layer can contain the following binders: for example, as hydrophilic colloids, proteins such as gelatin, colloidal albumin, casein, etc.; cellulose compounds such as carboxymethyl cellulose, hydroxyethyl cellulose, etc.; sugar derivatives such as agar, sodium alginate, starch derivatives, etc.; and synthetic hydrophilic colloids, such as polyvinyl alcohol, poly-N-vinyl pyrrolidone, a polyacrylic acid copolymer, polyacrylamide, or their derivatives or partially hydrolyzed products. If desired, a mixture of two or more of these colloids can be used.

Of these colloids, gelatin is most commonly used. By the term "gelatin" as used herein is meant a so-called lime-treated gelatin, an acid-treated gelatin, or an enzyme-treated gelatin. A part or the whole of the gelatin can be replaced by a synthetic polymeric substance. Additionally, those prepared by treating or modifying gelatin derivatives with a reagent having one group capable of reacting with an amino group, an imino group, a hydroxy group or a carboxyl group contained in the gelatin derivative molecule, or those prepared by replacing molecular chains of polymeric substances with bonded graft polymers can be used.

The silver halide emulsion for use in the photographic light-sensitive material of this invention is ordinarily prepared by mixing a solution of a water-soluble silver salt (e.g., silver nitrate) and a solution of a water-soluble halide (e.g., potassium bromide) in the presence of a solution of a water-soluble polymer such as gelatin. As silver halide, in addition to silver chloride and silver bromide, mixed silver halides such as silver chlorobromide, silver iodobromide, silver chloroiodobromide, etc., can be used.

These silver halide particles can be prepared by known and commonly used methods. It is, for instance, useful to employ the so-called single jet method, double jet method, controlled double jet method, etc. These photographic emulsions can be prepared by various methods including the ammonia method, neutral method, acidic method, etc., which are described, for example, in T. H. James & C. E. K. Mees, *The Theory of the Photographic Process,* 3rd Ed., Macmillan, and P. Glafikides, *Chemie Photographique,* Paul Montel, and which are in common use.

Silver halide particles so prepared can be increased in sensitivity without forming large particles by heat-treating in the presence of a chemical sensitizer (e.g., sodium thiosulfate, N,N,N'-trimethyl thiourea, a thiocyanate complex salt of a univalent gold, a thiosulfuric acid complex salt of a univalent gold, stannous chloride, hexamethylenetetramine, etc.).

Spectral sensitization or supersensitization of the photographic emulsion can be attained by adding polymethine sensitizing dyes such as cyanine, merocyanine, carbocyanine, etc., alone or in combination with each other, or by adding them in combination with styryl dyes, etc.

Various compounds can be added to the photographic emulsion for the photographic light-sensitive material of this invention in order to prevent a reduction in sensitivity and the occurrence of fog during the process of production of the light-sensitive material, the storage or processing thereof. As such compounds, a large number of compounds such as heterocyclic compounds including 4-hydroxy-6-methyl-1,3,3a,7-tetrazaindene-3-methylbenzothiazole, 1-phenyl-5-mercaptotetrazole, etc., mercury-containing compounds, mercapto compounds, metal salts, etc., have long been known. Examples of compounds which can be used in this invention are described in T. H. James & C. E. K. Mees, *The Theory of the Photographic Process,* 3rd Ed., Macmillan (1966), citing the original references.

Where the silver halide photographic emulsion is used in a color photographic light-sensitive material, it can contain a coupler. Examples of such couplers include four-equivalent diketomethylene based yellow couplers and two-equivalent diketomethylene based yellow couplers, e.g., those as described in U.S. Pat. Nos. 3,277,157, 3,408,194, 3,551,155, Japanese Patent Application (OPI) Nos. 26133/72, 66836/73, etc.; four-equivalent or two-equivalent pyrazolone based magenta couplers and indazolone based magent couplers, e.g., those as described in U.S. Pat. Nos. 2,600,788, 3,214,437, 3,476,560, Japanese Patent Application (OPI) No. 26133/72, etc.; α-naphthol based cyan couplers and phenol based cyan couplers, e.g., those as described in U.S. Pat. Nos. 2,474,293, 3,311,476, 3,481,741, etc., and so on can be used. In addition, couplers capable of releasing a development inhibitor, as described in U.S. Pat. Nos. 3,227,554, 3,253,924, 3,379,529, 3,617,291, 3,770,436, etc., can be used.

The silver halide emulsion layer and other layers of the photographic light-sensitive material of this invention can be hardened using various organic or inorganic hardeners, alone or in combination with each other. Representative examples of such hardeners include aldehyde compounds such as mucochloric acid, formaldehyde, trimethylolmelamine, glyoxal, 2,3-dihydroxy-1,4-dioxane, 2,3-dihydroxy-5-methyl-1,4-dioxane, succinaldehyde, glutaraldehyde, etc.; active vinyl compounds such as divinylsulfone, methylenebismaleimide, 1,3,5-triacryloylhexahydro-s-triazine, 1,3,5-trivinylsulfonyl-hexahydro-s-triazinebis(vinylsulfonyl)ether, 1,3-bis(vinylsulfonylmethyl)propanol-2, bis(α-vinylsulfonylacetamido)ethane, etc.; active halogen compounds such as 2,4-dichloro-6-hydroxy-s-triazine sodium salt, 2,4-dichloro-6-methoxy-s-triazine, etc.; ethyleneimine compounds such as 2,4,6-triethyleneimino-s-triazine, etc.; and the like.

Surface active agents can be added, alone or in admixtures comprising two or more thereof, to the photographic layer. These surface active agents can be used as auxiliary coating agents, but in some cases, they are used for other purposes, for example, improvements in emulsification and dispersion, sensitization, and other photographic characteristics, and adjustment of electrification.

There are various types of useful surface active agents, such as natural surface active agents such as saponin, etc.; nonionic surface active agents such as alkyleneoxide-, glycerin-, glycidol- or like-based ones; cationic surface active agents such as higher alkylamines, quaternary ammonium salts, heterocyclic compounds, e.g., pyridine, etc., phosphonium or sulfonium, etc.; anionic surface active agents containing acidic groups, such as carboxylic acid, sulfonic acid, phosphoric acid, sulfuric acid ester, phosphoric acid ester, etc.; and amphoteric surface active agents such as amino acids, aminosulfonic acids, sulfuric acid or phosphoric acid esters of aminoalcohol, and so forth.

Examples of surface active agents which can be used in this invention are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974, 3,666,478, 3,507,660, British Patent 1,198,450, and Ryohei Oda, et al., *Kaimenkasseizai no Gosei to sono Oyo* (*Synthesis of Surface Active Agent and its Application*), Maki Shoten, Tokyo (1964), A. W. Perry, *Surface Active Agents,* Interscience Publication Incorporated (1958), J. P. Sisley, *Encyclopedia of Active Agents,* Vol. 2, Chemical Publish Company (1964), etc.

In this invention, fluorine-containing surface active agents can be used in combination with the above-described surface active agents. For example, fluorine-containing surface active agents as described in British Pat. Nos. 1,330,356, 1,524,631, U.S. Pat. Nos. 3,666,478, 3,589,906, Japanese Patent Publication No. 26687/77, Japanese Patent Application (OPI) Nos. 46733/74, 32322/76, etc., can be used.

Typical examples of such fluorine-containing surface active agents include N-perfluorooctylsulfonyl-N-propylglycin potassium salt, 2-(N-perfluorooctylsulfonyl-N-ethylamino)ethyl phosphate, N-[4-(perfluorononenyloxy)benzyl]-N,N-dimethylammonium acetate, N-[3-(N',N',N'-trimethylammonio)propyl]perfluorooctylsulfonamido iodide, N-(polyoxyethylenyl)-N-propylperfluorooctyl sulfonamide [$C_8F_{17}SO_2N(C_3H_7)(CH_2CH_2O)_nH$], and fluorine-containing succinic acid based compounds, etc.

The photographic layer of this invention can contain a lubricating composition, for example, modified silicones as described in U.S. Pat. Nos. 3,079,837, 3,080,317, 3,545,970, 3,294,537, and Japanese Patent Application (OPI) No. 129520/77.

The photographic light-sensitive material of this invention can contain in the photographic layer thereof polymer latexes as described in U.S. Pat. Nos. 3,411,911, 3,411,912, Japanese Patent Publication No. 5331/70, etc., and as a matting agent, silica, strontium sulfate, barium sulfate, polymethyl methacrylate or the like.

This invention permits to improve troubles based on static marks or lines which are formed during the production of the photographic light-sensitive material and/or during the use thereof. For example, the practice of this invention has markedly reduced the formation of static marks which are caused by contact between an emulsion layer and the backing layer, between an emulsion layer and another emulsion layer, and between the photographic light-sensitive material and those which generally come in contact therewith, such as rubber, metal, plastics, X-ray intensifying screen, etc.

The following examples are given to illustrate this invention in greater detail, but this invention is not limited thereto.

EXAMPLE 1

Samples 1 to 8, having a construction comprising an about 175μ thick polyethylene terephthalate film support, an emulsion layer, and a protective layer overlaid on both sides of the support, were prepared by a conventional method. The composition of each layer was as follows:

Emulsion Layer (about 5μ)

Binder: gelatin 2.5 g/m$^2$
Amount of silver coated: 5 g/m$^2$
Composition of silver halide: AgI 1.5 mol. %, AgBr 98.5 mol. %
Hardening agent: 2,4-dichloro-6-hydroxy-1,3,5-triazine sodium salt 0.4 g/100 g gelatin
Antifoggant: 1-phenyl-5-mercaptotetrazole 0.5 g/Ag 100 g

Protective Layer (about 1μ)

Binder: gelatin 1.7 g/m$^2$
Coating agent: N-oleoyl-N-methyltaurine sodium salt 7 mg/m$^2$ Sample 1 contained no additional additives in the layers thereof, whereas Samples 2 through 7 contained in the protective layer thereof, respectively, 800 mg/m$^2$ of Copolymers (1), (2), (4), (5), (6) and (7) of this invention. Furthermore, for comparison, Sample 8 was prepared which contained in the protective layer thereof, 800 mg/m$^2$ of Comparative Polymer A in addition to the above compositions.

Comparative Polymer A

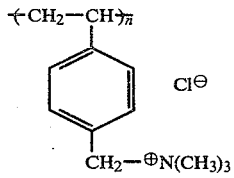

The antistatic properties of these samples were measured as follows:

An unexposed sample was adjusted in moisture at 25° C. and 25% RH for 2 hours, and the emulsion layer side of the sample was rubbed with a neoprene rubber roller in a dark room under the same atmospheric conditions as above. Thereafter, the sample was developed with a developer having the composition as shown below, fixed and washed with water to examine the formation of static marks.

| Composition of Developer | |
|---|---|
| Warm water | 800 ml |
| Sodium tetrapolyphosphate | 2.0 g |
| Anhydrous sodium sulfite | 50 g |
| Hydroquinone | 10 g |
| Sodium carbonate (monohydrate) | 40 g |
| 1-Phenyl-3-pyrazolidone | 0.3 g |
| Potassium bromide | 2.0 g |
| Water to make (pH 10.2) | 1,000 ml |

The unexposed sample was exposed to light through a filter, Filter SP-14 (produced by Fuji Photo Film Co., Ltd.) at an exposure amount of 1.6 CMS (i.e., candela-meter-second) by the use of a tungsten lamp, developed with the same developer as used above (at 35° C. for 30 seconds), fixed and washed with water, and thereafter its sensitivity and fog wear measured. Independently, the unexposed sample was stored for 3 days at 50° C. and it was then exposed to light and processed under the same conditions as above. Thereafter, its sensitivity and fog were measured to examine the influences of the added copolymer or polymer on the photographic characteristics.

The antistatic properties and photographic properties of these samples are shown in Table 1.

TABLE 1

| Sample No. | Antistatic Agent | Antistatic Properties: Degree of Formation of Static Marks | Photographic Properties: Just after Coating: Fog | Just after Coating: Sensitivity | After Storage: Fog | After Storage: Sensitivity |
|---|---|---|---|---|---|---|
| 1 | None Control | D | 0.16 | 0 | 0.17 | −0.01 |
| 2 | Copolymer (1) This Invention | A | 0.16 | 0 | 0.16 | 0 |
| 3 | Copolymer (2) This Invention | A | 0.16 | 0 | 0.16 | 0 |
| 4 | Copolymer (4) This Invention | A | 0.16 | 0 | 0.17 | 0 |
| 5 | Copolymer (5) This Invention | A | 0.16 | 0 | 0.16 | 0 |
| 6 | Copolymer (6) This Invention | A | 0.16 | 0 | 0.17 | −0.01 |
| 7 | Copolymer (7) This Invention | A | 0.16 | 0 | 0.16 | 0 |
| 8 | Comparative Polymer A For Comparison | B | 0.23 | +0.05 | 0.48 | Impossible to evaluate* |

*Sensitivity of Sample No. 8 could not be evaluated due to large fog.

The degree of formation of static marks was evaluated as follows:

A: No static marks were observed.
B: Some static marks were observed.
C: Many static marks were observed.
D: Static marks wer observed all over the surface.

The value of sensitivity was expressed in terms of the absolute value of log E (whrein E is a deviation from the basic sensitivity value of Control Sample (Sample No. 1) just after the coating), and no deviation from the basic sensitivity indicates that there are influences on the photographic properties.

As can be seen from the results shown in Table 1, the copolymers of this invention have excellent antistatic effect and furthermore exert no adverse influences on photographic properties such as fog, sensitivity, etc. On the other hand, the comparative polymer exerts great adverse influences on photographic properties, e.g., an increase in fog, although it has good antistatic effect.

EXAMPLE 2

Eight grams of each of Copolymers (2), (3), (8) and (11) of this invention was dissolved in a mixed solvent of 10 ml of water, 650 ml of methanol and 350 ml of acetone. The solution so prepared was coated on a cellulose triacetate film in an amount of 50 mg/$m_2$ and dried. On the layer so coated was further coated a solution of diacetyl cellulose in a mixed solvent of 850 ml of acetone and 150 ml of methanol.

An indirect Roentgen photographic emulsion containing 9% by weight of gelatin and 9% by weight of silver halide was coated on the reverse side of the cellulose triacetate film.

The sheets containing each of Copolymers (2), (3), (8) and (11) of this invention were designated, respectively, as Samples 10, 11, 12 and 13. As a control sheet, a sheet containing no antistatic agent was prepared and is designated as Sample 9.

These samples were examined in antistatic properties in the same manner as in Example 1 except that the back surface opposite to the emulsion surface was rubbed with a neoprene rubber roller. The results are shown in Table 2.

TABLE 2

| Sample No. | Antistatic Agent | | Degree of Formation of Static Marks |
|---|---|---|---|
| 9 | None | Control | D |
| 10 | Copolymer (2) | This Invention | A |
| 11 | Copolymer (3) | This Invention | A |
| 12 | Copolymer (8) | This Invention | A |
| 13 | Copolymer (11) | This Invention | A |

As can be seen from the results shown in Table 2, the use of the copolymers of this invention in the backing layer markedly improves the antistatic effect.

EXAMPLE 3

Samples 14 to 17 comprising a cellulose triacetate support, an antihalation layer on the support, a red-sensitive layer on the antihalation layer, an intermediate layer on the red-sensitive layer, a green-sensitive layer on the intermediate layer, a yellow filter layer on the green-sensitive layer, a blue-sensitive layer on the yellow filter layer and a protective layer on the blue-sensitive layer were prepared by a conventional method. The composition of each layer was as follows:

Antihalation Layer

Binder: gelatin 4.4 g/$m^2$
Hardening Agent: 1,3-bis(vinylsulfonyl)propanol-2 1.2 g/100 g binder
Auxiliary Coating Agent: sodium dodecylbenzene-sulfonate 4 mg/$m^2$
Antihalation Component: black colloidal silver 0.4 g/$m^2$

Red-Sensitive Layer

Binder: gelatin 7 g/$m^2$
Hardening Agent: 1,3-bis(vinylsulfonyl)propanol-2 1.2 g/100 g binder
Auxiliary Coating Agent: sodium dodecylbenzenesulfonate 10 mg/$cm^2$
Amount of Coated silver: 3.1 g/$m^2$
Composition of Silver Halide: AgI 2 mol %, AgBr 98 mol %
Fog Restrainer: 4-hydroxy-6-methyl-1,3,3a,7-tetrazaindene 0.9 g/Ag 100 g
Coupler: 1-hydroxy-4-(2-acetylphenyl)azo-N-[4(2,4-di-tert-amylphenoxy)butyl]-2-naphthamide 38 g/Ag 100 g
Sensitizing Dye: anhydro-5,5'-dichloro-9-ethyl-3,3'-di(3-sulfopropyl)thiacarbocyanine hydroxide.-pyridinium salt 0.3 g/Ag 100 g

Intermediate Layer

Binder: gelatin 2.6 g/$m^2$
Hardening Agent: 1,3-bis(vinylsulfonyl)propanol-2 1.2 g/100 g binder
Auxiliary Coating Agent: sodium dodecylbenzenesulfonate 12 mg/$m^2$

Green-Sensitive Layer

Binder: gelatin 6.4 g/$m^2$
Hardening Agent: 1,3-bis(vinylsulfonyl)propanol-2 1.2 g/100 g binder
Auxiliary Coating Agent: sodium dodecylbenzenesulfonate 9 mg/$m^2$
Amount of Coated Silver: 2.2 g/$m^2$
Composition of Silver Halide: AgI 3.3 mol %, AgBr 96.7 mol %
Stabilizer: 4-hydroxy-6-methyl-1,3,3a,7-tetrazaindene 0.6 g/Ag 100 g
Coupler: 1-C2,4,6-trichlorophenyl)-3-{3-[(2,4-ditert-amylphenoxy)acetoazido]}-4-(4-methoxyphenyl)-azo-5-pyrazolone 37 g/Ag 100 g
Sensitizing Dye: anhydro-5,5'-diphenyl-9-ethyl-3,3'-di(2-sulfoethyl)oxacarbocyanine hydroxide.-pyridinium salt 0.3 g/Ag 100 g

Yellow Filter Layer

Binder: gelatin 2.3 g/$m^2$
Filter Component: yellow colloidal silver 0.7 g/$m^2$
Hardening Agent: 1,3-bis(vinylsulfonyl)propanol-2 1.2 g/100 g binder
Surface Active Agent: 2-sulfonatosuccinic acid bis(2-ethylhexyl)ester sodium salt 7 mg/$m^2$

Blue-Sensitive Layer

Binder: gelatin 7 g/$m^2$
Hardening Agent: 1,3-bis(vinylsulfonyl)propanol-2 1.2 g/100 g binder
Auxiliary Coating Agent: sodium dodecylbenzenesulfonate 8 mg/$m^2$
Amount of Coated Silver: 2.2 g/$m^2$
Composition of Silver Halide: AgI 3.3 mol %, AgBr 96.7 mol %
Stabilizer: 4-hydroxy-6-methyl-1,3,3a,7-tetrazaindene 0.4 g/Ag 100 g
Coupler: 2'-chloro-5'-[2-(2,4-di-tert-amylphenoxy)-butyramido]-α-(5,5'-dimethyl-2,4-dioxo-3-oxazolidinyl)-α-(4-methoxybenzoyl)acetanilide 45 g/Ag 100 g

Protective Layer:

Binder: gelatin 2 g/$m^2$, a styrene-maleic anhydride (1:1) copolymer having an average molecular weight of about 100,000 0.3 g/$m^2$
Hardening Agent: 1,3-bis(vinylsulfonyl)propanol-2 1.2 g/100 g binder
Auxiliary Coating Agent: sodium dioctylsulfosuccinate 5 mg/$m^2$ Sample 14 contained no additional compound, whereas Sample 15, 16 and 17 contained in the protective layer 800 mg/m$^2$ of Copolymers (2) and (4) of this invention and Comparative Polymer A, respectively. These samples were processed in the same manner as in Example 1 except that a usual color development processing was employed in place of the black-and-white development processing, and their antistatic properties and photographic properties were examined. The results are shown in Table 3.

TABLE 3

| Sample No. | Antistatic Agent | | Degree of Formation of Static Marks |
|---|---|---|---|
| 14 | None | Control | D |
| 15 | Copolymer (2) | This Invention | A |
| 16 | Copolymer (4) | This Invention | A |
| 17 | Comparative Polymer A | For Comparison | C |

As apparent from Table 3, almost no static marks were observed in the samples in which the copolymer of this invention were used.

On the other hand, these samples were exposed to light according to the JIS method and were subjected to a usual color development processing. In Sample 17 wherein the comparative polymer was used, there was a great increase in fog in all the blue-, green- and red-sensitive layers, whereas in Samples 15 and 16, almost no adverse influences on the photographic properties were observed.

EXAMPLE 4

A backing layer and a back protective layer were coated on one surface of a cellulose triacetate film support and the same light-sensitive layer as in the control sample (Sample No. 1) of Example 1 was coated on the other surface of the film support. The compositions of the backing layer and the back protective layer were as follows:

Backing Layer

Binder: gelatin 6.2 g/m$^2$
Salt: potassium nitrate 0.2 g/m$^2$
Hardening Agent: 1,3-bis(vinylfulfonyl)propanol-2 1.2 g/100 g binder

Back Protective Layer

Binder: gelatin 2.2 g/m$^2$
Matting Agent: polymethyl methacrylate (average grain size 2.5$\mu$) 20 mg/m$^2$
Hardening Agent: 1,3-bis(vinylsulfonyl)propanol-2 1.2 g/100 g binder
Auxiliary Coating Agent: sodium dioctylsulfosuccinate 40 mg/m$^2$ Sample 18 contained no additional copolymer, whereas Samples 19, 20, 21, and 22 contained in the backing layer thereof 1.0 g/m$^2$ of Copolymer (1), (5), (7) and (10) of this invention, respectively. The degree of formation of static marks was examined in the same manner as in Example 1 except that the back surface of each sample was rubbed with a neoprene rubber roller. The results are shown in Table 4.

TABLE 4

| Sample No. | Antistatic Agent | | Degree of Formation of Static Marks |
|---|---|---|---|
| 18 | None | Control | D |
| 19 | Copolymer (1) | This Invention | A |
| 20 | Copolymer (5) | This Invention | A |
| 21 | Copolymer (7) | This Invention | A |
| 22 | Copolymer (10) | This Invention | A |

From the results shown in Table 4, it can be seen that the copolymers of this invention can effectively be used in preventing electrification.

EXAMPLE 5

The same light-sensitive material as Sample 1 of Example 1 was soaked in a 2% by weight aqueous solution of each of the copolymers as shown in Table 5 for 5 seconds, and it was then allowed to dry under the conditions of 25° C. and 65% RH. These samples were adjusted in moisture for 2 hours at 25° C. and 25% RH, and their antistatic properties were measured in the same manner as in Example 1 under the same conditions as above. The results are shown in Table 5.

TABLE 5

| Sample No. | Antistatic Agent | | Degree of Formation of Static Marks |
|---|---|---|---|
| 23 | None | Control | D |
| 24 | Copolymer (1) | This Invention | A |
| 25 | Copolymer (3) | This Invention | A |
| 26 | Copolymer (9) | This Invention | A |
| 27 | Copolymer (10) | This Invention | A |

As apparent from the results shown in Table 5, dip-coating of the copolymer of this invention as an aqueous solution is effective in improving the antistatic properties.

EXAMPLE 6

A solution having the formulation as shown below was coated on a 130$\mu$thick gelatin-coated cellulose triacetate film to form an antistatic layer.

| | |
|---|---|
| Antistatic Agent | 8 g |
| Water | 10 ml |
| Methanol | 600 ml |
| Acetone | 400 ml |

On this antistatic layer, an antihalation layer and the red-sensitive layer as described in Example 3, in sequence (from the support), were coated by an extrusion method. The unevenness in coating of the emulsion layer due to the charging phenomenon at the time of coating was judged with the naked eye by means of a transmitted light. The results are shown in Table 6.

TABLE 6

| Sample No. | Antistatic Agent | Unevenness in Coating |
|---|---|---|
| 28 | None | Marked unevenness |
| 29 | Copolymer (4) | Almost no unevenness |
| 30 | Copolymer (7) | Almost no unevenness |

As is apparent from the results shown in Table 6, the samples containing the antistatic agents of this invention between the undercoat layer and the emulsion layer suffered almost no unevenness in coating at the time of coating the emulsion.

EXAMPLE 7

The same samples as Samples 1 to 8 of Example 1, and Sample 31, which was the same as Sample 8 except that Comparative Polymer B was used in place of Comparative Polymer A, were prepared. A specimen (4 cm×4 cm) was taken from each sample and then controlled in moisture for 2 days at 40° C. and 75% RH. The protective layers were brought into contact with each other, stored for 1 day under the conditions of 40° C. and 75% RH under a load of 800 g, and stripped from each other. The area of the adhered portion was measured and evaluated according to the following standards.

| | Area of Adhered Portion |
|---|---|
| A | 0 to 40% |
| B | 41 to 60% |
| C | 61 to 80% |
| D | 80% or more |

The results are shown in Table 7.

Comparative Polymer B

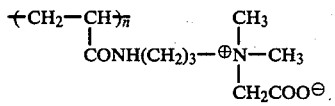

TABLE 7

| Sample No. | (Example 1) | Adhesion Resistance |
|---|---|---|
| 1 | Control | C |
| 2 | This Invention | A |
| 3 | This Invention | A |
| 4 | This Invention | A |
| 5 | This Invention | A |
| 6 | This Invention | A |
| 7 | This Invention | A |
| 8 (Comparative Polymer A) | For Comparison | D |
| 31 (Comparative Polymer B) | For Comparison | C |

As can be seen from the results shown in Table 7, the samples wherein the copolymers of this invention are used are excellent in the adhesion resistance. On the other hand, the sample wherein Comparative Polymer B is used is poor in the adhesion resistance like the control sample, and the sample wherein Comparative Polymer A is used is lower in the adhesion resistance than the control sample.

While the invention has been described in detail and with reference to specific embodiments thereof, it will be apparent to one skilled in the art that various changes and modifications can be made therein without departing from the spirit and scope thereof.

What is claimed is:

1. A silver-halide photographic light-sensitive multilayered element containing a copolymer within a photographic layer, said copolymer being prepared by copolymerizing a betaine group-containing monomer and a fluorine atom-containing monomer in at least one photographic layer, wherein the total of the betaine group-containing monomer and fluorine atom-containing monomer content is at least 50 mol. %, and wherein said betaine group-containing monomer is represented by formula (I)

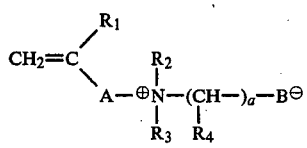

(I)

wherein

A can represent an alkylene group containing from 1 to 6 carbon atoms, an arylene group containing from 7 to 11 carbon atoms, an aralkylene group containing from 8 to 12 carbon atoms, a $-COOR_5-$, $-CONHR_5-$, or

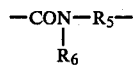

group wherein $R_5$ is an alkylene group containing from 1 to 6 carbon atoms, and $R_6$ is an alkyl group containing from 1 to 8 carbon atoms, or A can form, together with

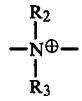

group, a heterocyclic ring or a group containing a heterocyclic ring;

$R_1$ is hydrogen or a lower alkyl group;

$R_2$ and $R_3$ (which may be the same or different) can represent an alkyl group containing 1 to 6 carbon atoms, an aryl group containing from 7 to 11 carbon atoms, or

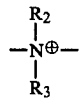

can form, together with A, a heterocyclic ring or a group containing a heterocyclic ring;

$R_4$ is hydrogen or an alkyl group containing 1 to 6 carbon atoms;

a is a positive integer from 1 to 6; and $B^{\ominus}$ is a $-COO^{\ominus}$ or $-SO3^{\ominus}$;

and further wherein said fluorine atom-containing monomer is represented by the formula (II)

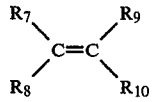

(II)

wherein $R_7$, $R_8$, $R_9$, $R_{10}$ is each hydrogen, a fluorine atom; a lower alkyl group; $-(CF_2)_n-F$, wherein n is an integer from 1 to 8; $-O(CF_2)_nF$, wherein n is an integer from 2 to 8; $-O(CF_2)_nH$, wherein n is an integer from 2 to 8; $-COO(CH_2)_nH$, wherein m is an integer from 1 to 3 and n is an integer from 2 to 8; $-COO(CH_2)_m(CF_2)_nF$, wherein m is an integer from 1 to 3, and n is an integer from 2 to 8;

$$-COO(CH_2)_mN(R_{11})-SO_2(CF_2)_nF,$$

wherein m is an integer from 1 to 3, and n is an integer from 2 to 8, and $R_{11}$ is an alkyl group containing from 1 to 4 carbon atoms; $-COO(CH_2)_mO-(CF_2)_nF$, wherein m is an integer from 1 to 3, and n is an integer from 2 to 8, $$-COO(CH_2)_mCH(OH)CH_2(CF_2)_nF,$$

wherein m is an integer from 1 to 3, and n is an integer from 2 to 8;

$$-COOCH_2(CF_2-CF(CF_3))_nH,$$

wherein n is an integer from 1 to 4; $-OCO-(CH_2)_m(CF_2)_nF$, wherein m is zero or an integer from 1 to 3, and n is an integer from 1 to 8; $-OCO(CH_2)_m(CF_2)_nH$, wherein m is zero or an integer from 1 to 3, and n is an integer from 1 to 8;

$$-COOC(R_{12})(R_{14})-R_{13},$$

wherein $R_{12}$, $R_{13}$ and $R_{14}$ each is a fluorine atom or a fluorine-substituted alkyl group containing 1 to 4 carbon atoms; $-CONH(CF_2)_nF$, wherein n is an integer from 2 to 8; or $-CONH(CF_2)_nH$, wherein n is an integer from 2 to 8; and at least one of $R_7$, $R_8$, $R_9$ and $R_{10}$ is a group containing a fluorine atom.

2. A silver halide photographic light-sensitive material as in claim 1, wherein said photographic layer is a layer other than the silver halide emulsion layer.

3. A silver halide light-sensitive material as in claim 1, wherein said photographic layer is selected from the group consisting of a surface protective layer, a backing layer, and an overcoat layer.

4. A silver halide photographic light-sensitive material as in claim 1, wherein A is an alkylene group containing from 1 to 3 carbon atoms, an arylene group containing from 7 to 9 carbon atoms, an aralkylene group containing 8 carbon atoms, a $-COOR_5-$, $-CONHR_5-$, or $$-CON(R_6)-R_5-$$

group wherein $R_5$ is an alkylene group containing from 1 to 4 carbon atoms and $R_6$ is an alkyl group containing from 1 to 4 carbon atoms, or A can form, together with $$-N^{\oplus}(R_2)(R_3)-$$

group, a heterocyclic ring or a group containing a heterocyclic ring;

$R_1$ is hydrogen or a methyl group;

$R_2$ and $R_3$ can represent an alkyl group containing from 1 to 4 carbon atoms, an aryl group containing from 7 to 9 carbon atoms, or $$-N^{\oplus}(R_2)(R_3)-$$

can form, together with A, a heterocyclic ring or a group containing a heterocyclic ring;

$R_4$ is hydrogen or an alkyl group containing from 1 to 3 carbon atoms, a is a positive integer from 1 to 4, and $B^{\ominus}$ has the same meaning as defined in claim 1.

5. A silver halide photographic light-sensitive material as in claim 7, wherein the betaine-containing monomer content is from 95 to 50 mol. % and the fluorine-containing monomer content is from 50 to 5 mol. %.

6. A silver halide photographic light-sensitive material as in claim 1 or 2, wherein the copolymer is coated in an amount of from 0.01 g to 20 g per square meters of the photographic material.

* * * * *